United States Patent [19]

Rosz

[11] Patent Number: 5,077,648

[45] Date of Patent: Dec. 31, 1991

[54] MINIMAL GLARE HEADLAMP

[76] Inventor: Cass A. Rosz, 16445 Erin St., Fraser, Mich. 48026

[21] Appl. No.: 634,052

[22] Filed: Dec. 26, 1990

[51] Int. Cl.[5] ..... F21V 7/00

[52] U.S. Cl. ..... 362/299; 362/308; 362/61; 362/343; 362/301

[58] Field of Search ..... 362/61, 80, 308, 328, 362/343, 301, 299, 346, 362

[56] References Cited

U.S. PATENT DOCUMENTS

| | | | |
|---|---|---|---|
| 1,567,193 | 12/1925 | Ritz-Woller | 362/80 |
| 1,598,044 | 8/1926 | Bone | 362/61 |
| 2,699,515 | 1/1955 | Williams | 362/308 |
| 3,088,023 | 4/1963 | Ayroldi . | |
| 3,598,989 | 8/1971 | Biggs | 362/308 |
| 4,175,280 | 11/1979 | Plewka | 362/61 |
| 4,689,728 | 8/1987 | Yamai et al. | 362/268 |
| 4,897,767 | 1/1990 | T'Jampens | 362/61 |
| 4,922,398 | 5/1990 | Muto | 362/61 |
| 4,967,319 | 10/1990 | Seko | 362/61 |
| 4,755,9191 | 6/1988 | Lindae et al. | 362/304 |

FOREIGN PATENT DOCUMENTS

| | | | |
|---|---|---|---|
| 457595 | 12/1936 | United Kingdom | 362/308 |

*Primary Examiner*—Ira S. Lazarus
*Assistant Examiner*—Diana M. Cox
*Attorney, Agent, or Firm*—Peter D. Keefe

[57] ABSTRACT

A headlamp having minimal glare, composed of a housing having preferably a non-reflective interior, an electric bulb located within the housing and a simple convex lens mounted to the housing and through which external illumination is provided. For purposes of incrementing the illumination output, a flat mirror is placed rearwardly of the electric bulb. According to this structural configuration, no concentrated beams of light are created, and illumination is pleasingly uniform and of minimal glare.

8 Claims, 1 Drawing Sheet

MINIMAL GLARE HEADLAMP

BACKGROUND OF THE INVENTION

1. Field of the Invention

The present invention relates to electric light sources, and more particularly to an electric light source which provides illumination virtually without glare. Still more particularly, the present invention relates to an electric light assembly and associated housing therefor which provides a headlamp having a minimal amount of glare for automotive applications.

2. Description of the Prior Art

Electric lights are extremely well known in the prior art for providing illumination. Electric lights used for automotive purposes generally are four component devices. The four components consist of a housing; a bulb located within the housing, the bulb having an electrically heated filament for providing light; a concave mirror located within the housing at a rearward end, the concave mirror culminating and reflecting the light forwardly of the bulb; and a compound lens located at an aperture in the housing forwardly of the bulb, the lens serving to condense the light into a predetermined pattern of beams.

While this construction is proper from an engineering standpoint, it fails to take into account that the concave reflector and compound lens concentrate the light emitted from the bulb into beam patterns which glare when viewed by the human eye. Consequently, the light emitted from the electric lights, especially headlamps, is harsh and decidedly difficult for the eye to accommodate, particularly as caused by the concave shape of the concave reflector.

There have been certain attempts in the prior art to address the issue of glare in automotive electric lights. U.S. Pat. No. 3,088,023 to Ayroldi, dated Apr. 30, 1963, discloses an automotive headlamp having an ellipsoidal reflector, a bulb, a diaphragm having a small central aperture, a baffle, and a convex lens. U.S. Pat. No. 3,598,989 to Biggs, dated Aug. 10, 1971, discloses a headlamp having a bulb, a curved reflector, a slitted gate and a convex lens. U.S. Pat. No. 4,175,280 to Plewka, dated Nov. 20, 1979 discloses a headlamp having auxiliary lights to light-up the front vehicle so as to reduce contrast and, therefore, glare. U.S. Pat. No. 4,755,919 to Lindae et al., dated July 5, 1988, discloses a headlamp in which the reflector is shaped in a predetermined configuration so as to reduce glare. U.S. Pat. No. 4,922,398 to Muto, dated May 1, 1990, discloses a lamp assembly in which glare is controlled by use of a cylindrical mask adjacent the bulb, the mask permitting only curved surfaces of the reflector to reflect light. Finally, U.S. Pat. No. 4,967,319 to Seko, dated Oct. 30, 1990, discloses a headlamp having a reflector, bulb, convex lens, an internal shader plate and an adjustment mechanism to change the optical axis upon detection of an approaching vehicle.

In spite of ubiquitous complaints about headlamp glare, there yet remains in the art no viable solution. Consequently, what is needed is a simple, effective headlamp system that solves the glare problem while yet providing an acceptable amount of illumination.

SUMMARY OF THE INVENTION

The present invention is a headlamp having minimal no glare. The headlamp according to the present invention is composed of a housing having a preferably non-reflective interior, an electric bulb located within the housing and a simple convex lens mounted to the housing and through which external illumination is provided. For purposes of incrementing the illumination output, a flat mirror is placed rearwardly of the electric bulb. According to this structural configuration, no concentrated beams of light are created, and illumination is pleasingly uniform and of minimal glare.

Accordingly, it is an object of the present invention to provide an electrical light providing minimal glare illumination.

It is an additional object of the present invention to provide an automotive headlamp providing minimal glare illumination.

It is yet an additional object of the present invention to provide a headlamp having minimal glare due to absence of a concave reflector.

It is a further object of the present invention to provide an electric light, particularly an automotive headlamp, which provides minimal glare, pleasingly uniform illumination in that the appearance of concentrated beams of light are avoided.

It is a yet a further object of the present invention to provide an electric light, particularly an automotive headlamp, which provides minimal glare illumination and is inexpensive and of simple construction.

These, and additional objects, advantages, features and benefits of the present invention will become apparent from the following specification.

DETAILED DESCRIPTION OF THE PREFERRED EMBODIMENT

Figure 1:
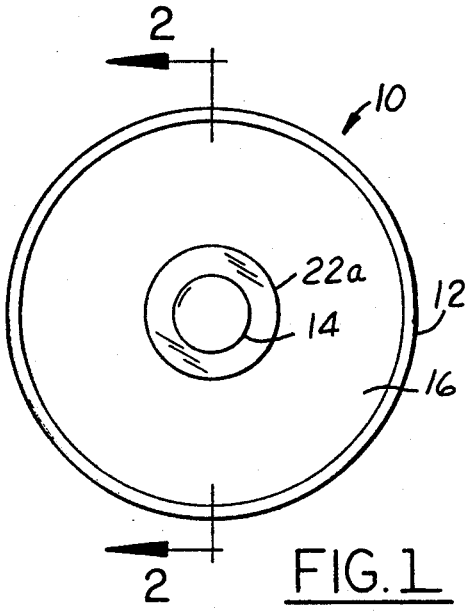
FIG. 1 is a frontal view of the headlamp according to the present invention.
Figure 2:
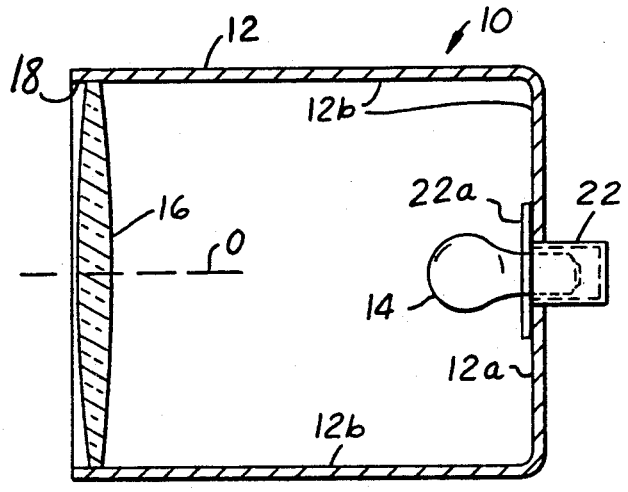
FIG. 2 is a partly sectional side view of the headlamp according to the present invention, seen along lines 2—2 in FIG. 1.
Figure 3:
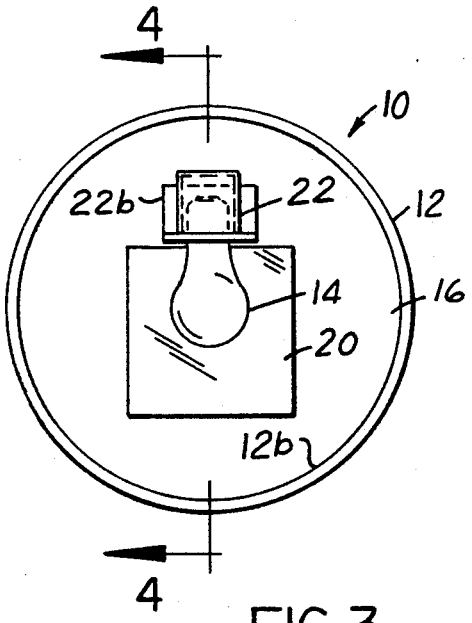
FIG. 3 is a frontal view of the headlamp according to the present invention, now including an optional flat reflector.
Figure 4:
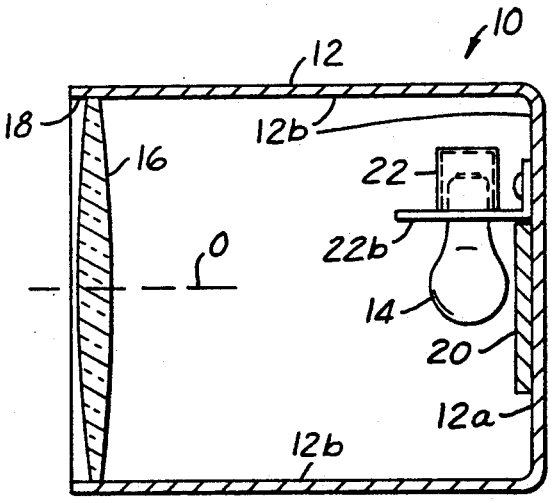
FIG. 4 is a partly sectional side view of the headlamp according to the present invention, seen along lines 4—4 in FIG. 3.

Referring now to the Drawing, FIGS. 1 through 4 generally show the headlamp 10 according to the present invention. It will be seen that FIGS. 1 and 2 show a basic configuration of the headlamp 10 including a housing 12, an electric light bulb 14, and a simple convex lens 16 located at an aperture 18 in the housing. It will be further seen that FIGS. 3 and 4 show the basic configuration of the headlamp 10, but now with the addition of a flat reflector 20. The headlamp 10 provides a soft, uniform, minimal glare illumination forwardly of the simple convex lens 16 in that no component of the headlamp causes concentrations of light into beams. One major reason for the illumination being of minimal glare is that the headlamp 10 has no concave reflector. It is important in this regard, that the bulb be placed at a location with respect to the simple convex lens so that the light emitted from the bulb is optimally focused by the simple convex lens.

Turning specific attention now to FIGS. 1 and 2, the structural and operational details of the headlamp 10 will be more fully elaborated. The electric light bulb 14 is preferred to be a standard socket mount type which plugs into an electrical socket 22. The electric light bulb is mounted to the inside rear wall 12*a* of the housing 12 via the electrical socket 22. A mounting bracket 22*a* facilitates the aforesaid connection. The electrical socket is provided with electrical connections to the automotive electrical system (not shown). Spaced forwardly from the electric light bulb 14 is the simple convex lens 16. The simple convex lens is mounted to the housing 12 at the aperture 18 therein. In order that glare be minimized, it is preferred that the simple convex lens be spaced relative to the electric light bulb so that the light emitted from the electric light bulb originates on the optical axis O of the simple convex lens and is then focused by the simple convex lens; in other words, the electric light bulb is preferred to be located at the focal point of the simple convex lens. Further, it is within the contemplation of the present invention to provide a prepared surface 12*b* on the interior surface of the housing 12, which may selectively take the form of anywhere between a reflective to a non-reflective property, inclusive; non-reflective generally being preferred. It is preferred that the electrical socket 22 be mounted with respect to the inside rear wall 12*a* so that the electric light bulb 14 plugs into the electrical socket in an orientation parallel with respect to the optical axis O.

Referring now to FIGS. 3 and 4, it will be seen that a flat reflector 20 has been added and the electric light bulb 14 has been mounted 90 degrees with respect to its orientation of mounting in FIGS. 1 and 2, all other structural details of the headlamp 10 remaining unchanged. A mounting bracket 22*b* having a flange for connection to the rear inside wall 12*a* of the housing 12 attaches the electrical socket 22 to the housing 12. The electric light bulb 14 is oriented so that it plugs into the electrical socket in a direction perpendicular with respect to the optical axis O. Attached to the inside rear wall immediately adjacent the electric light bulb, in-line with the optical axis, is the flat reflector 20. The flat reflector is preferred to be substantially larger than the cross-section of the electric light bulb. A preferred suitable structure for the flat reflector is a flat mirror. The purpose of providing the flat reflector is to increase the light output at the simple convex lens 16, and the purpose of changing the orientation of mounting of the electric light bulb is so that the light emitted will not be obstructed by the electrical socket or its mounting bracket with respect to the flat reflector. Again, in order that glare be minimized, the simple convex lens should be located with respect to the electric light bulb and the flat reflector such that the light is in best focus along the optical axis.

It is to be understood by those skilled in the art, that while the description herein relates to an automotive headlamp, in fact, the present invention is readily adaptable to all manner of other types of electric lights utilizing ordinary skill in the art. For instance, flashlights and searchlights may utilize the structure herein presented, and further, the present invention may be adapted to automotive electric lights other than only headlamps. Further, the term "electrical light bulb" used herein is generic for any electrical light producing device. Also, to further minimize glare when an incandescent filament is used, the electric light bulb may be frosted, or light diffusing media may be provided.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An electric light having minimal glare characteristics, said electric light being interconnected with a source of electricity, said electric light comprising:

a housing having an aperture, said housing having an interior wall surface, said interior wall surface being non-reflective;

an electric light bulb located within said housing, said electric light bulb being mounted with respect to said housing; and a lens mounted with respect to said housing at said aperture, said lens being a simple convex lens, said lens having an optical axis, said electric light bulb being located with respect to said lens along said optical axis such that light emitted from said electric light bulb is focused by said lens;

wherein all surfaces located within said housing are non-reflective; wherein said electric light bulb emits light when the source of electricity is activated with respect to the electric light bulb, and further wherein illumination is provided by said light exiting from said lens.

2. The electric light of claim 1, wherein said lens is located with respect to said electric light bulb such that light emitted from said electric light bulb is optimally focused by said lens to provide illumination.

3. The electric light of claim 1, further comprising electrical socket means for connecting said electric light bulb to said housing.

4. The electric light of claim 3, wherein said electrical socket means is mounted with respect to said housing so that said electric light bulb mounts to said electrical socket means in a direction parallel with respect to said optical axis of said lens; further wherein said electric light bulb is a standard socket mount electric light bulb.

5. An electric light having minimal glare characteristics, said electric light being interconnected with a source of electricity, said electric light comprising:

a housing having an aperture, said housing having an interior wall surface, said interior wall surface being non-reflective;

an electric light bulb located within said housing, said electric light bulb being mounted with respect to said housing;

a lens mounted with respect to said housing at said aperture, said lens being a simple convex lens, said lens having an optical axis, said electric light bulb being located with respect to said lens along said optical axis such that light emitted from said electric light bulb is focused by said lens; and a flat reflector mounted to said housing adjacent said electric light bulb opposite said lens at a location along said optical axis;

wherein all surfaces located within said housing are non-reflective except with respect to said flat reflector; wherein said electric light bulb emits light when the source of electricity is activated with respect to the electric light bulb, further wherein illumination is provided by said light exiting from said lens.

6. The electric light of claim 5, wherein said lens is located with respect to said electric light bulb and said flat reflector such that light emitted from said electric light bulb and reflected by said flat reflector is optimally focused by said lens.

7. The electric light of claim 6, further comprising electrical socket means for connecting said electric light bulb to said housing.

8. The electric light of claim 7, wherein said electrical socket means is mounted with respect to said housing so that said electric light bulb mounts to said electrical socket means in a direction perpendicular with respect to said optical axis of said lens; further wherein said electric light is a standard socket mount electric light bulb.

* * * * *